US005328237A

United States Patent [19]

Yamaguchi et al.

[11] Patent Number: 5,328,237

[45] Date of Patent: Jul. 12, 1994

[54] SHOCK ABSORBER FOR A BACK REST OF A CHAIR

[75] Inventors: Tomoshige Yamaguchi, Yokosuka; Nobuaki Nasu, Yokohama, both of Japan

[73] Assignee: Okamura Corporation, Japan

[21] Appl. No.: 905,039

[22] Filed: Jun. 26, 1992

[30] Foreign Application Priority Data

Jun. 26, 1991 [JP] Japan ..... 3-180480

[51] Int. Cl.[5] ..... A47C 1/032

[52] U.S. Cl. ..... 297/304; 297/301

[58] Field of Search ..... 297/304, 306, 301, 300

[56] References Cited

U.S. PATENT DOCUMENTS

| | | | |
|---|---|---|---|
| 2,272,980 | 2/1942 | McLellan et al. | 297/304 X |
| 4,200,332 | 4/1980 | Brauning | 297/300 |
| 4,479,679 | 10/1984 | Fries et al. | 297/300 |
| 4,653,806 | 3/1987 | Willi | 297/300 |
| 4,830,431 | 5/1989 | Inoue | 297/300 |
| 5,042,876 | 8/1991 | Faiks | 297/300 X |
| 5,150,948 | 9/1992 | Volkle | 297/301 |
| 5,207,479 | 5/1993 | Wickman et al. | 297/304 X |
| 5,238,294 | 8/1993 | Ishi et al. | 297/301 |

FOREIGN PATENT DOCUMENTS

| | | | |
|---|---|---|---|
| 63186605 | 10/1986 | Japan . | |
| 6432658 | 8/1987 | Japan . | |
| 85451 | 6/1957 | Netherlands | 297/303 |

*Primary Examiner*—Peter M. Cuomo

*Assistant Examiner*—Jerry Redman

*Attorney, Agent, or Firm*—Poms, Smith, Lande & Rose

[57] ABSTRACT

A shock absorber employable for a back rest of a chair is operatively associated with a pair of support arms for the back rest via an engagement piece turnably supported by a first shaft. A mounting frame is turnably supported by a second shaft while a pair of compression springs mounted on spring mounting rods are received in the mounting frame between a slidable spring support portion and a rear wall of the mounting frame. The engagement piece is adapted to turn about the first shaft together with the support arms while it is engaged with an engagement portion bridged between the rear ends of the spring mounting rods. In addition, a guide member is slidably bridged between the spring mounting rods outside of the rear wall of the mounting frame, and a nut is turnably received in the guide member to turn about a third shaft. The nut is threadably engaged with an adjustment bolt. When a handle fixedly secured to the adjustment bolt is rotated in a predetermined direction so as to allow the engagement portion integrally bridged between the rear ends of the spring mounting rods to assume the lower position in the vicinity of the first shaft, a weak shock absorbing function is exhibited for the back rest. When the handle is rotated in the opposite direction so as to allow the engagement portion to assume the upper position remote away from the first shaft, a strong shock absorbing function is exhibited for the back rest.

6 Claims, 4 Drawing Sheets

SHOCK ABSORBER FOR A BACK REST OF A CHAIR

BACKGROUND OF THE INVENTION

1. Field of the Invention

The present invention relates generally to a shock absorber employable for a back rest of a chair. More particularly, the present invention relates to a shock absorber operable for properly absorbing shock caused when an user sits on the chair and then reclines against the back rest of the chair.

2. Description of the Related Art

A chair of the type including a pair of turnable support arms for supporting a reclinable back rest at the upper ends thereof has been hitherto known as disclosed in official gazettes of, e.g., Japanese Patent Laid-Open Pub. NO. 63-186605 and Japanese Utility Model Laid-Open Pub. NO. 64-32658.

According to each of the prior inventions, a quantity of expansion/contraction of compression springs for absorbing shock caused by inclination of the back rest in the rearward direction is adequately adjusted by rotating a handle with an user's hand so as to vary an intensity of biasing force generated by the compression springs, whereby an optimum intensity of shock absorbing function is provided for the back rest of the chair.

With the conventional chair constructed in the above-described manner, since an intensity of repulsive force from the compression springs is increased as the compression springs are compressed more and more by rotating the handle to enhance the biasing force generated by the compression springs, there arises a problem that the handle should be rotated with a higher intensity of force as the biasing force is increased, resulting in the handle being rotated with much difficulties.

When an intensity of the biasing force is variably adjusted, the compression springs are compressed or expanded within the allowable extent of compression and expansion of the compression springs. However, since the intensity of the biasing force largely varies merely by slight rotation of the handle, there arises other problem, that it is difficult to finely adjust the biasing force within the wide range of intensity.

Once the biasing force of the compression springs is adjusted to assume a high intensity, a strong shock absorbing function appears immediately after an user reclines against the back rest of the chair to enjoy a pleasant resting attitude. For this reason, there arises another problem that an adequate shock absorbing function can not be obtained with the conventional chair when the user reclines against the back rest of the chair.

SUMMARY OF THE INVENTION

The present invention has been made in consideration of the aforementioned problems inherent to the prior art.

An object of the present invention is to provide a shock absorber operable for properly absorbing shock caused when an user sits on a chair and then reclines against a back rest of the chair wherein a handle for adjusting the extent of a shock absorbing function as required can smoothly and easily be actuated with user's fingers.

Another object of the present invention is to provide a shock absorber operable for properly absorbing shock caused when an user sits on a chair and then reclines against a back rest of the chair wherein the biasing force generated by compression springs can finely be adjusted within the wide range while an user enjoys a pleasant resting attitude.

According to the present invention, there is provided a shock absorber operable for properly absorbing shock caused when an user sits on a chair and then reclines against a back rest of the chair, the back rest including a pair of support arms for turnably supporting the back rest at the upper ends thereof, the lower ends of the support arms being pivotally held by a first transversely extending shaft at the rear end part of a base frame fixedly mounted on the upper end of a foot column for the chair, wherein the shock absorber comprises a mounting frame of which fore end is turnably supported by a second transversely extending shaft fixedly secured to the base frame, the second transversely extending shaft extending through the mounting frame; a pair of spring mounting rods of which fore ends are received in the mounting frame while slidably extending through a rear wall of the mounting frame in the longitudinal direction, the fore ends of the spring mounting rods being fixedly secured to a spring support portion slidably arranged on the mounting frame and the rear ends of the same being connected to each other via an engagement portion bridged therebetween; a pair of compression springs mounted on the spring mounting rods in the spring mounting frame between the spring support portion and the rear wall of the mounting frame; an engagement piece adapted to turn about the first transversely extending shaft together with the support arms, the engagement piece being slidably engaged with the engagement portion bridged between the rear ends of the spring mounting rods; a guide member slidably bridged between the spring mounting rods at the rear end parts of the latter outside of the rear wall of the mounting frame, the guide member having a nut received therein; an adjustment bolt threadably engaged with the nut; and a handle fixedly secured to the outer end of the adjustment bolt, the handle being located outside of the base frame to rotate the adjustment bolt with user's fingers.

It is preferable that the spring mounting rods are prepared in the form of an elongated U-shaped spring mounting rod comprising parallel straight portions and an U-shaped engagement portion integrally bridged between the rear ends of the straight portions.

The nut threadably engaged with the adjustment bolt is turnably arranged in the guide frame to turn about a third transversely extending shaft which extends through the guide member.

To assure that adjustment of the extent of a shock absorbing function of the shock absorber is easily and smoothly achieved, it is desirable that the rear surface of the engagement piece is configured in the form of an arched surface which extends with the second transversely extending shaft as a center in the concentrical relationship relative to the same.

When the mounting frame is turnably displaced in the downward direction by rotating the handle in a predetermined direction so as to allow the engagement portion of the spring mounting rods to assume the position on the rear surface of the engagement piece in the vicinity of the first transversely extending shaft, a weak shock absorbing function is exhibited for the back rest of the chair. On the contrary, when the mounting frame is turnably displaced in the upward direction by rotating the handle in the opposite direction so as to allow the engagement portion of the spring mounting rods to assume the position on the rear surface of the engagement piece remote away from the first transversely shaft, a strong shock absorbing function is exhibited for the back rest of the chair.

According to the present invention, the engagement portion of the spring mounting rods is engaged with the rear surface of the engagement piece adapted to turn together with the support arms at all times, and a distance of slidable movement of the spring mounting rods is enlarged more and more as the engagement portion is engaged with the rear surface of the engagement piece at the position more remote away from the first transversely shaft. Thus, a higher intensity of biasing force can be obtained with the shock absorber. In addition, when the engagement position is variably adjusted, the handle can easily be rotated, since the rear surface of the engagement piece is configured in the form of an arched surface which extends with the second transversely extending shaft as a center in the concentrical relationship relative to the same.

Further, since the biasing force of the compression springs is adjusted from the position in the proximity of the first transversely extending shaft to the position remote away from the same and vice versa, fine adjustment of the biasing force can simply be achieved within the wide positional range.

Comparing case that the engagement position is located in the vicinity of the first transversely extending shaft to impart a weak shock absorbing function to the back rest with case that it is located at the position remote away from the same to impart a strong s hock absorbing function to the same, there is not recognized a significant difference therebetween in the initial biasing force of the compression springs. A weak shock absorbing function appears immediately after the user sits on the chair and then reclines against the back rest of the chair, and subsequently, an intensity of the biasing force is gradually enlarged. Thus, the user can enjoy a pleasant resting attitude.

Additionally, since the handle is fixedly secured to the adjustment bolt at the position outside of the base frame, the user can easily rotate the handle with his fingers to change the engagement position as desired.

Other objects, features and advantages of the present invention will become apparent from reading of the following description which has been made in conjunction with the accompanying drawings.

BRIEF DESCRIPTION OF THE DRAWINGS

The present invention is illustrated in the following drawings in which:

FIG. 3 (*b*) is a fragmentary plan view of the shock absorber shown in FIG. 3(*a*), particularly illustrating the spring mounting frame and the compression springs in the operative state of the shock absorber that the back rest is inclined in the rearward direction;

FIG. 4 (*b*) is a sectional view of the shock absorber shown in FIG. 4(*a*), particularly illustrating the operative state of the shock absorber that the back rest is inclined in the rearward direction;

FIG. 5(*b*) is a sectional view of the shock absorber shown in FIG. 5(*a*), particularly illustrating the operative state of the shock absorber that the back rest is inclined in the rearward direction.

DESCRIPTION OF THE PREFERRED EMBODIMENT

Now, the present invention will be described in detail hereinafter with reference to the accompanying drawings which illustrate the structure of a shock absorber operable for properly absorbing shock caused when an user sits on a chair and then reclines against a back rest of the chair (hereinafter referred to simply as a shock absorber) in accordance with an embodiment of the present invention.

Figure 1:
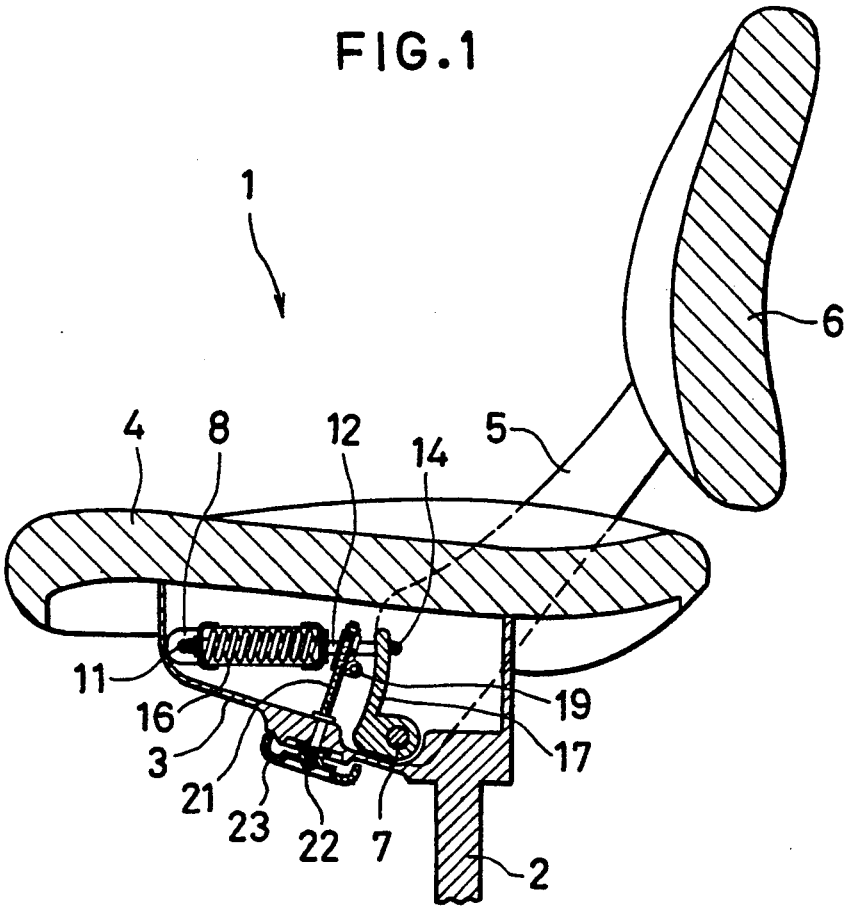
FIG. 1 is a sectional view of a shock absorber operable for properly absorbing shock caused when an user sits on a chair and then reclines against a back rest of the chair in accordance with an embodiment of the present invention, particularly illustrating essential components constituting the shock absorber.

Referring to FIG. 1, a chair 1, of which whole structure is not shown in the drawing, includes a foot column 2 having a caster (not shown) secured to the lower end thereof, and the upper end of the foot column 2 is kept open to integrally form a forwardly extending base frame 3. A seat 4 is fixedly placed on the upper end of the base frame 3. As is apparent from the drawing, the base frame 3 is integrated with the foot column 3.

In FIG. 1, reference numeral 5 designates a pair of support arms (only one of them being shown in the drawing). A back rest 6 is turnably supported by the upper ends of the support arms 5 of which lower ends are pivotally held by a shaft 7.

Figure 3A:
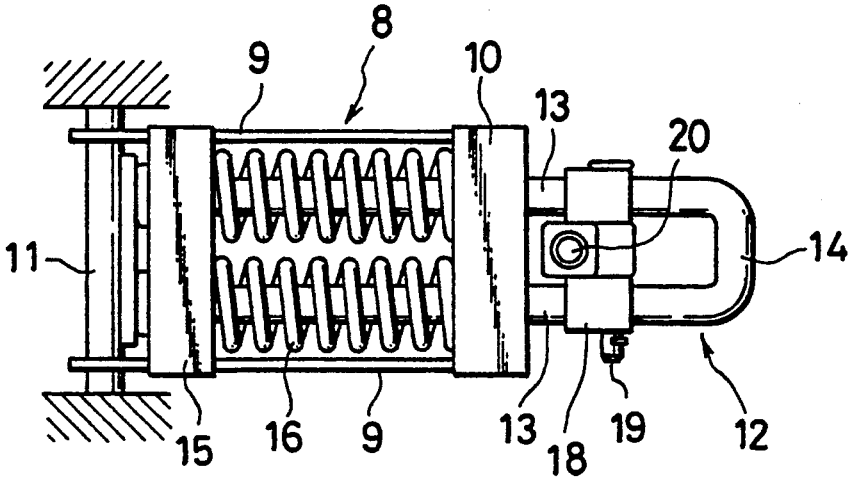
FIG. 3(*a*) is a fragmentary plan view of the shock absorber, particularly illustrating a spring mounting rod and compression springs constituting the shock absorber in the inoperative state.
Figure 3B:
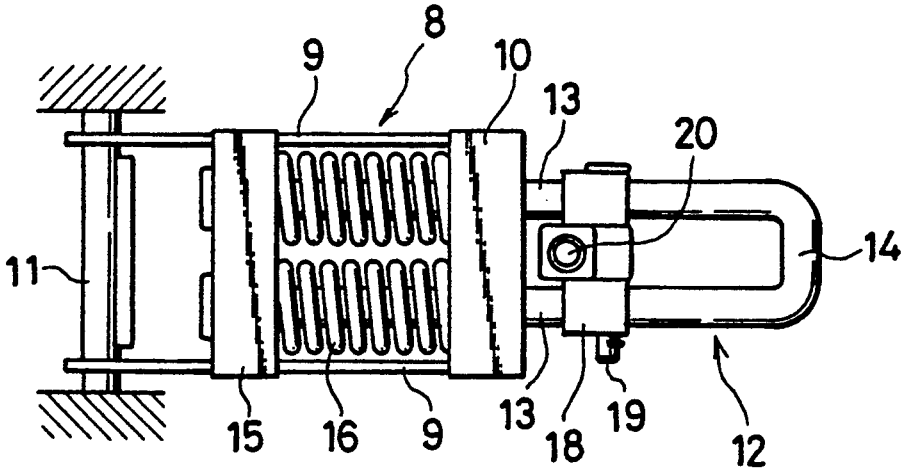

Reference numeral 8 designates a mounting frame. As shown in FIGS. 3(*a*) and 3(*b*), the mounting frame 8 is constructed of an opposing pair of side plates 9 and a rear wall 10 bridged between the side plates 9.

A shaft 11 extends through the side plates 9 at the fore end part of the mounting frame 8 so that the mounting frame 8 is turnably supported by the shaft 11 at the fore end part of the base frame 3.

An elongated U-shaped longitudinally displaceable spring mounting rod 12 is received in the mounting frame 8. The spring mounting rod 12 is constructed of straight portions 13 and an engagement portion 14 transversely extending therebetween in the U-shaped configuration, and extends through a rear wall 10 of the mounting frame 8. A spring support portion 15 is bridged between the side plates 9 of the mounting frame 8, and the fore ends of the straight portions 13 of the spring mounting rod 12 are fixedly secured to the spring support portion 15. The spring support portion 15 is slidably mounted on the side plates 9 of the mounting frame 8 so as to slidably move along the side plates 9.

A compression spring 16 is mounted on each straight portion 13 of the spring mounting rod 12 between the spring support portion 15 and the rear wall 10 of the mounting frame 8.

An upwardly extending engagement piece 17 adapted to turn about the shaft 7 together with the support arms 5 is mounted on the shaft 7 for turnably supporting the support arms 5, and the rear surface of the engagement piece 7 is operatively engaged with the engagement portion 14 of the spring mounting rod 12.

The rear surface of the engagement piece 17 is configured in the form of an arched surface which extends with the shaft 11 as a center in the concentrical relationship relative to the same.

Figure 2:
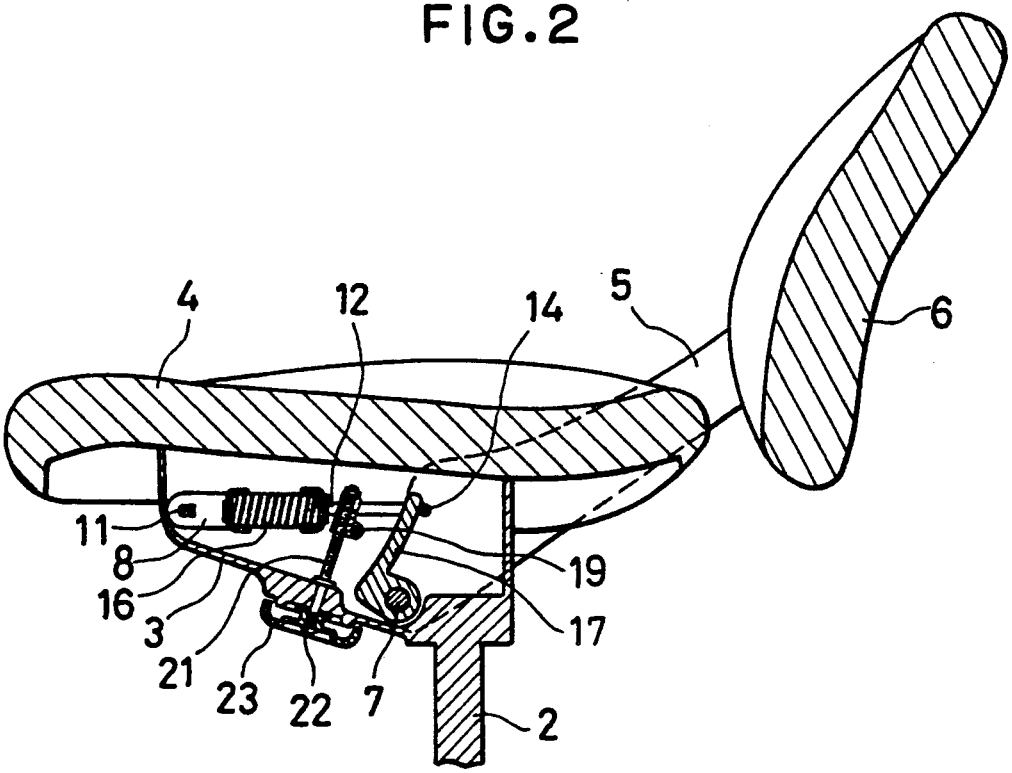
FIG. 2 is a sectional view of the shock absorber shown in FIG. 1, particularly illustrating the operative state of the shock absorber that the back rest is inclined in the rearward direction.

With such construction, as the back rest 6 is inclined in the rearward direction against the resilient force of each compression spring 16 while the shock caused by the rearward inclination of the back rest 6 is absorbed by the compression springs 16, the engagement piece 17 is likewise inclined in the rearward direction, as shown in FIG. 2. At this time, the compression springs 16 are compressed between the spring support portion 15 for the spring mounting rod 12 and the rear wall 10 of the mounting wall 8, as shown in FIG. 3 (*b*).

Figure 4A:
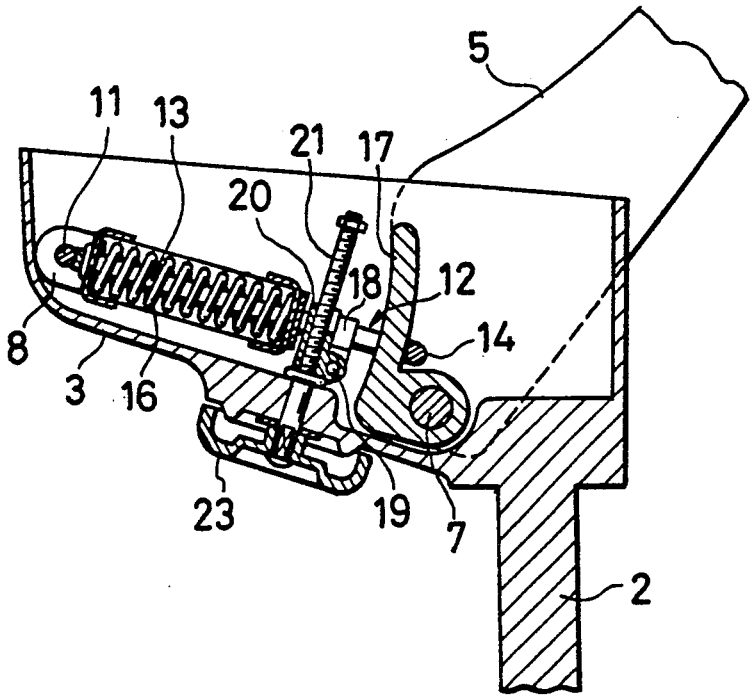
FIG. 4(*a*) is a sectional view of the shock absorber, particularly illustrating the shock absorber in the inoperative state while an intensity of each compression spring is set to a low level.
Figure 4B:
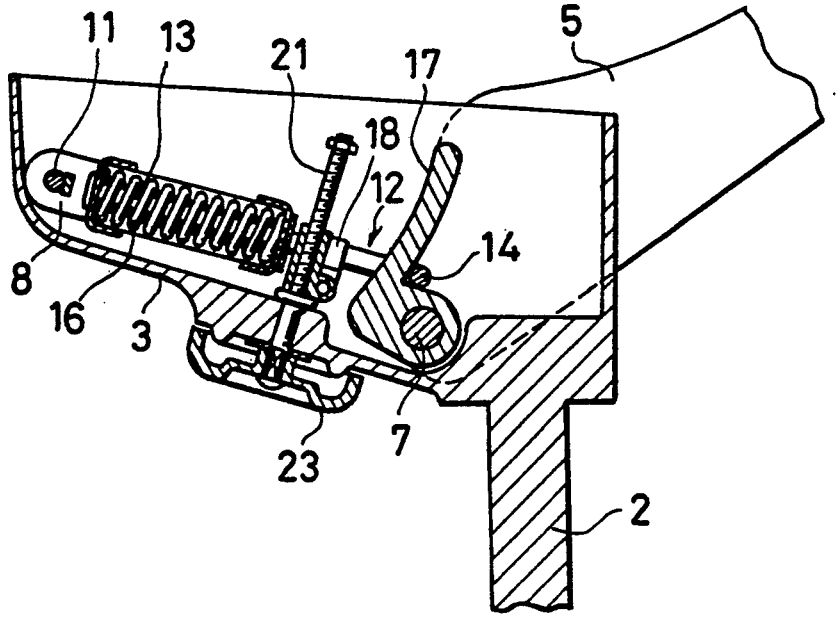

A guide member 18 is bridged between the straight portions 13 of the spring mounting rod 12 so as to slidably move relative to them, and a nut 20 is turnably received in the guide member 18 with the aid of a transversely extending shaft 19 (see FIG. 4).

An adjustment bolt 21 is threadably inserted through the nut 20 such that its lower end part is projected outside of the lower surface of the base frame 3. A handle 23 is fixedly secured to the projected part 22 of the adjustment bolt 21.

Next, a mode of operation of the shock absorber constructed in the above-mentioned manner will be described below with reference to FIG. 4 and FIG. 5.

FIG. 4 shows by way of sectional views the structure of of the shock absorber, wherein FIG. 4(*a*) is a sectional view of the shock absorber, particularly illustrating the operative state of the shock absorber that the handle 23 is rotated to threadably displace the adjustment bolt 21 through the nut 20 so that the mounting frame 8 is turnably displaced in the downward direction while turning about the shaft 11, whereby the engagement position is located in the vicinity of the shaft 7, and FIG. 4(*b*) is a sectional view of the same, particularly illustrating the operative state of the shock absorber that the back rest of the chair is inclined in the rearward direction.

Figure 5A:
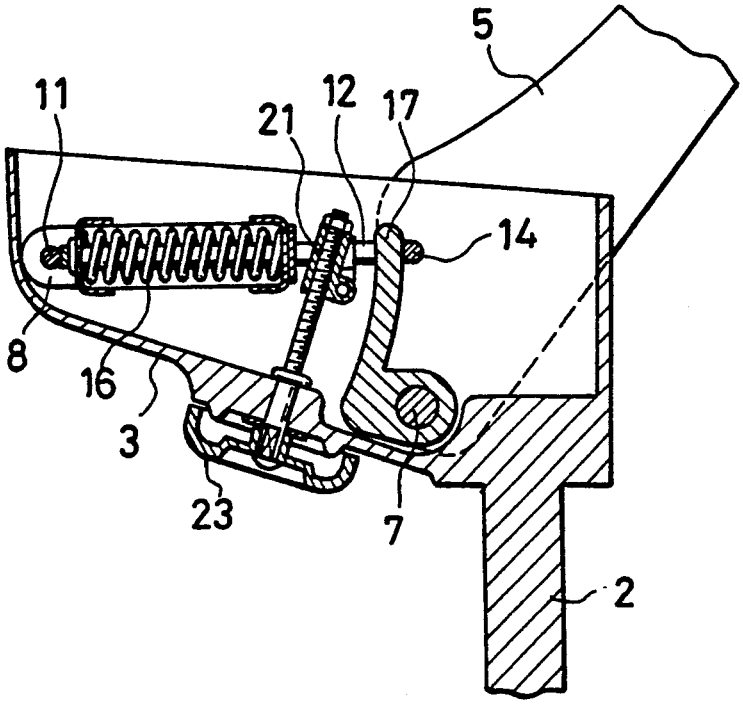
FIG. 5 (*a*) is a sectional view of the shock absorber, particularly illustrating the shock absorber in the inoperative state while an intensity of each compression spring is set to a high level.
Figure 5B:
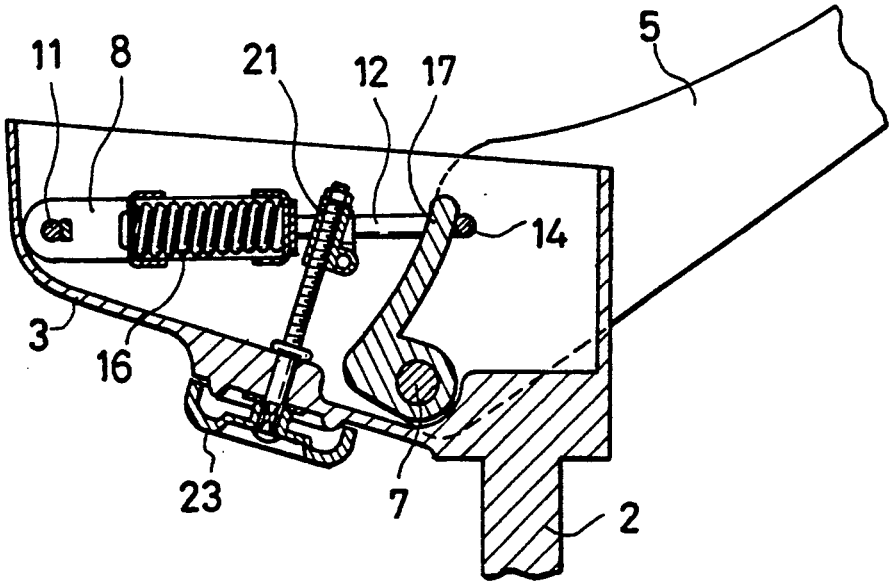

FIG. 5 shows by way of sectional views the structure of the shock absorber wherein FIG. 5(*a*) is a sectional view of the shock absorber, particularly illustrating the operative state of the shock absorber that the handle 23 is rotated in the opposite direction to that in FIG. 4(*a*) so that the mounting frame 8 is turnably displaced in the upward direction while turning about the shaft 11, whereby the engagement position is located remote from the shaft 7, and FIG. 5(*b*) is a sectional view of the same, particularly illustrating the operative state of the shock absorber that the back rest of the chair is inclined in the rearward direction.

Referring to FIG. 4, since the engagement portion 14 of the spring mounting rod 12 is engaged with the engagement piece 17 at the position in the vicinity of the shaft 7 for the support arms 5, the spring mounting rod 12 slidably moves at a short distance as the support arms 5 are inclined in the rearward direction. Thus, the support arms 5 are inclined with a low intensity of biasing force.

In contrast with the operative state of the shock absorber shown in FIG. 4, when the engagement portion 14 of the spring mounting rod 12 is engaged with the engagement piece 17 at the position remote away from the shaft 7 for the support arms 5 as shown in FIG. 5, the spring mounting rod 12 slidably moves at a long distance. Thus, the support arms 5 are inclined with a high intensity of biasing force.

When there arises a necessity for changing the position where the the engagement portion 12 of the spring mounting rod 12 is engaged with the engagement piece 17, the handle 23 is rotated to turnably displace the spring mounting rod 12 in a predetermined direction via threadable engagement of the nut 20 with the adjustment bolt 21. It should be added that a high intensity of actuating force is not required for rotating the handle 23, enabling the engagement position to be changed easily.

Since arbitrary adjustment of the biasing force of the compression springs 16 is achieved by displacing the engagement portion 14 of the spring mounting rod 12 along the rear surface of the engagement piece 17 within the range extending from the position in the vicinity of the shaft 7 to the position remote away from the same and vice versa, the biasing force of the compression springs 16 can simply be adjusted within the wide positional range.

Comparing case that the engagement position is located in the vicinity of the shaft 7 for the support arms 5 to impart a weak shock absorbing function to the back rest 6 with case that the former is located remote away from the latter to impart a strong shock absorbing function to the back rest 7, there is not recognized a significant difference therebetween in the initial biasing force given by the compression springs 16. In other words, the shock absorbing function of the shock absorber increasingly varies from the initial time when a weak shock absorbing function is imparted to the back rest 6. Thus, the user can enjoy a pleasant resting attitude with the shock absorber at all times.

Since the rear surface of the engagement piece 17 is configured in the form of an arched surface in the concentrical relationship relative to the shaft 11 transversely extending through the mounting frame 8, the biasing force of the compression springs 16 does not substantially vary at any position during turning movement of the spring mounting rod 12 about the shaft 11 when the engagement position is to be changed. Thus, the handle 23 can smoothly be rotated to turnably displace the spring mounting rod 12 in that way without any excessive load imparted to user's fingers.

Although the present invention has been described above with respect to a single preferred embodiment thereof, it should of course be understood that the present invention should not be limited only to this embodiment but various change or modification may be made without departure from the scope of the claim as defined by the appended claims of the invention.

What is claimed is:

1. A shock absorber operable for properly absorbing shock caused when a user sits on a chair and then reclines against a back rest of said chair, said back rest including a pair of support arms for turnably supporting said back rest at upper ends thereof, lower ends of said support arms being pivotally held by a first transversely extending shaft at a rear end part of a base frame fixedly mounted on an upper end of a foot column for said chair, comprising:

a mounting frame having a front end which is turnably supported by a second transversely extending shaft fixedly secured to said base frame, said second transversely extending shaft extending through said mounting frame;

a pair of spring mounting rods comprising an elongated U-shaped spring mounting rod having parallel straight portions, said spring mounting rods having front ends which are received in said mounting frame while slidably extending through a rear wall of said mounting frame in a longitudinal direction, said front ends of said spring mounting rods being fixedly secured to a spring support portion slidably arranged on said mounting frame, said spring mounting rods further having rear ends which are connected to each other via an engagement portion bridged therebetween;

a pair of compression springs mounted on said spring mounting rods in said mounting frame between said spring support portion and said read wall of said mounting frame;

an engagement piece adapted to turn about said first transversely extending shaft together with said support arms, said engagement piece being slidably engaged with said engagement portion bridged between the rear ends of said spring mounting rods;

a guide member slidably bridged between said spring mounting rods at the rear ends of the spring mounting rods outside of said rear wall of said mounting frame, said guide member having a nut which is threadedly engaged with an adjustment bolt and is turnably arranged in said guide member to turn about a third transversely extending shaft which extends through said guide member; and a handle fixedly secured to an outer end of said adjustment bolt, said handle being located outside of said base frame to rotate said adjustment bolt with user's fingers.

2. The shock absorber according to claim 1, wherein said spring mounting rods are prepared in the form of an elongated U-shaped spring mounting rod comprising parallel straight portions and an U-shaped engagement portion integrally bridged between rear ends of said straight portions.

3. The shock absorber according to claim 1, wherein said nut threadably engaged with said adjustment bolt is turnably arranged in said guide member to turn about a third transversely extending shaft which extends through said guide member.

4. The shock absorber according to claim 1, wherein said engagement piece as a rear surface which is configured in the form of an arched surface which extends with said second transversely extending shaft as a center in a concentrical relationship relative to said engagement piece.

5. The shock absorber according to claim 1, wherein when said mounting frame is turnably displaced in a downward direction by rotating said handle in a predetermined direction so as to allow said engagement portion of said spring mounting rods to assume a position on the rear surface of said engagement piece in the vicinity of said first transversely extending shaft, a weak shock absorbing function is exhibited for said back rest, while when said mounting frame is turnably displaced in an upward direction by rotating said handle in the opposite direction so as to allow said engagement portion of said spring mounting rods to assume the position on the rear surface of said engagement piece remote away from said first transversely extending shaft, a strong shock absorbing function is exhibited for said back rest.

6. A shock absorber operable for properly absorbing shock caused when a user sits on a chair and then reclines against a back rest of said chair, said back rest including a pair of support arms for turnably supporting said back rest at upper ends thereof, lower ends of said support arms being pivotally held by a first transversely extending shaft at a rear end part of a base frame fixedly mounted on an upper end of a foot column for said chair, comprising:

a mounting frame having a front end which is turnably supported by a second transversely extending shaft fixedly secured to said base frame, said second transversely extending shaft extending through said mounting frame;

a pair of spring mounting rods comprising an elongated U-shaped spring mounting rod having parallel straight portions and an engagement portion integrally bridged between rear ends of said straight portions, said spring mounting rods having front ends which are received in said mounting frame while slidably extending through a rear wall of said mounting frame in a longitudinal direction, said front ends of said spring mounting rods being fixedly secured to a spring support portion slidably arranged on said mounting frame, said spring mounting rods further having rear ends which are connected to each other via an engagement portion bridged therebetween;

a pair of compression springs characterized by a bias force, said springs mounted on said spring mounting rods in said mounting frame between said spring support portion and said rear wall of said mounting frame;

an engagement piece adapted to turn about said first transversely extending shaft together with said support arms, said engagement piece being slidably engaged with said engagement portion bridged between the rear ends of said spring mounting rods;

a guide member slidably bridged between said spring mounting rods at the rear ends of the spring mounting rods outside of said rear wall of said mounting frame, said guide member having a nut which is threadedly engaged with an adjustment bolt; and a handle fixedly secured to an outer end of said adjustment bolt, said handle being located outside of said base frame to rotate said adjustment bolt, rotation of said handle causing said guide member nut to travel along said adjustment bolt and turnably displacing said mounting frame, thereby repositioning said guide member relative to said engagement piece and adjusting said bias force;

wherein:

when said mounting frame is turnably displaced in a downward direction by rotating said handle in a predetermined direction so as to allow said engagement portion of said spring mounting rods to assume a position on the rear surface of said engagement piece near said first transversely extending shaft, a weak shock absorbing mode is exhibited for said back rest, while when said mounting frame is turnably displaced in an upward direction by rotating said handle in an opposite direction so as to allow said engagement portion of said spring mounting rods to assume the position on the rear surface of said engagement piece away from said first transversely extending shaft, a strong shock absorbing mode is exhibited for said back rest; and irrespective of whether the engagement portion is located near said first transversely extending shaft to impart weak shock absorbing to the back rest, or away from said first transversely extending shaft to impart strong shock absorbing, said compression springs have a substantially consistent initial biasing force, so that shock absorbing is consistently weak immediately after a user reclines and then gradually enlarges, whereby a user can enjoy a pleasant resting attitude in both the weak shock absorbing mode and the strong shock absorbing mode.

* * * * *